US012410669B2

(12) United States Patent
Eitschberger

(10) Patent No.: US 12,410,669 B2
(45) **Date of Patent: *Sep. 9, 2025**

(54) ADAPTER ASSEMBLY FOR USE WITH A WELLBORE TOOL STRING

(71) Applicant: DynaEnergetics Europe GmbH, Troisdorf (DE)

(72) Inventor: Christian Eitschberger, Munich (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 18/477,968

(22) Filed: Sep. 29, 2023

(65) Prior Publication Data

US 2024/0026745 A1 Jan. 25, 2024

Related U.S. Application Data

(63) Continuation of application No. 17/545,147, filed on Dec. 8, 2021, now Pat. No. 11,814,915, which is a (Continued)

(51) Int. Cl.
*E21B 23/10* (2006.01)
*E21B 17/046* (2006.01)

(52) U.S. Cl.
CPC ..... *E21B 23/10* (2013.01); *E21B 17/046* (2013.01)

(58) Field of Classification Search
CPC ..... E21B 23/10; E21B 17/046; E21B 17/02; E21B 43/117; E21B 17/028; E21B 17/042
See application file for complete search history.

(56) References Cited

U.S. PATENT DOCUMENTS 1,775,403 A 9/1930 Mcleod
2,177,740 A 10/1939 Orndorff et al.
(Continued)

FOREIGN PATENT DOCUMENTS

CA 2003166 A1 5/1991
CA 2821506 A1 1/2015
(Continued)

OTHER PUBLICATIONS

United States Patent and Trademark Office; Notice of Allowance issued for U.S. Appl. No. 29/735,905 dated Apr. 10, 2024; 7 pages.
(Continued)

*Primary Examiner* — Yanick A Akaragwe
(74) *Attorney, Agent, or Firm* — Womble Bond Dickinson (US) LLP

(57) ABSTRACT

An adapter assembly may include a tandem seal adapter (TSA) and a collar. The TSA may include a TSA body extending along an axial direction. The collar may include a collar body, a first collar coupling, and a second collar coupling. The collar body may be a substantially annular shape extending in the axial direction. The collar may be outward from the TSA in a radial direction. The first collar coupling and the second collar coupling axially displaced from the first collar coupling may be provided on an interior surface of the collar body. The TSA body and the collar body may overlap in the axial direction. The first collar coupling, second collar coupling, and the TSA may define a first space respectively configured to receive an end of a first housing of a first wellbore tool and an end of a second housing of a second wellbore tool.

15 Claims, 10 Drawing Sheets

Related U.S. Application Data continuation of application No. 17/181,280, filed on Feb. 22, 2021, now Pat. No. 11,225,848, application No. 18/477,968 is a continuation-in-part of application No. 29/735,905, filed on May 26, 2020, now Pat. No. Des. 1,041,608.

(60) Provisional application No. 62/992,643, filed on Mar. 20, 2020.

(56) References Cited

U.S. PATENT DOCUMENTS 2,216,359 A 10/1940 Spencer
2,228,873 A 1/1941 Hardt et al.
2,296,198 A 9/1942 Alexander
2,326,406 A 8/1943 Lloyd
2,358,466 A 9/1944 Miller
2,418,486 A 4/1947 Smylie
2,519,116 A 8/1950 Crake
2,543,814 A 3/1951 Thompson et al.
2,598,651 A 5/1952 Spencer
2,621,744 A 12/1952 Toelke
2,655,993 A 10/1953 Lloyd
2,696,258 A 12/1954 Greene
2,734,456 A 2/1956 Sweetman
2,785,631 A 3/1957 Blanchard
2,889,775 A 6/1959 Owen
2,906,339 A 9/1959 Griffin
2,946,283 A 7/1960 Udry
2,982,210 A 5/1961 Andrew et al.
3,040,659 A 6/1962 Mcculleugh
RE25,407 E 6/1963 Lebourg
3,125,024 A 3/1964 Hicks et al.
3,155,164 A 11/1964 Keener
3,158,680 A 11/1964 Lovitt et al.
3,170,400 A 2/1965 Nelson
3,173,992 A 3/1965 Boop
RE25,846 E 8/1965 Campbell
3,246,707 A 4/1966 Bell
3,264,989 A 8/1966 Rucker
3,264,994 A 8/1966 Kurt
3,336,054 A 8/1967 Blount et al.
3,374,735 A 3/1968 Moore
3,426,849 A 2/1969 Brumble, Jr.
3,426,850 A 2/1969 Mcduffie, Jr.
3,504,723 A 4/1970 Cushman et al.
3,565,188 A 2/1971 Hakala
3,859,921 A 1/1975 Stephenson
4,007,790 A 2/1977 Henning
4,007,796 A * 2/1977 Boop ..... E21B 43/1185 102/306
4,039,239 A 8/1977 Cobaugh et al.
4,058,061 A 11/1977 Mansur, Jr. et al.
4,100,978 A 7/1978 Boop
4,107,453 A 8/1978 Erixon
4,132,171 A 1/1979 Pawlak et al.
4,140,188 A 2/1979 Vann
4,172,421 A 10/1979 Regalbuto
4,182,216 A 1/1980 DeCaro
4,191,265 A 3/1980 Bosse-Platiere
4,208,966 A 6/1980 Hart
4,220,087 A 9/1980 Posson
4,266,613 A * 5/1981 Boop ..... F42D 1/04 200/82 R
4,290,486 A 9/1981 Regalbuto
4,312,273 A 1/1982 Camp
4,363,529 A 12/1982 Loose
4,485,741 A 12/1984 Moore et al.
4,491,185 A 1/1985 McClure
4,496,008 A 1/1985 Pottier et al.
4,512,418 A 4/1985 Regalbuto et al.
4,523,649 A 6/1985 Stout
4,523,650 A 6/1985 Sehnert et al.
4,534,423 A 8/1985 Regalbuto
4,574,892 A 3/1986 Grigar et al.
4,598,775 A 7/1986 Vann et al.
4,609,057 A 9/1986 Walker et al.
4,621,396 A 11/1986 Walker et al.
4,629,001 A 12/1986 Miller et al.
4,637,478 A 1/1987 George
4,643,097 A 2/1987 Chawla et al.
4,650,009 A 3/1987 McClure et al.
4,657,089 A 4/1987 Stout
4,660,910 A 4/1987 Sharp et al.
4,730,793 A 3/1988 Thurber, Jr. et al.
4,744,424 A 5/1988 Lendermon et al.
4,747,201 A 5/1988 Donovan et al.
4,753,170 A 6/1988 Regalbuto et al.
4,756,363 A 7/1988 Lanmon et al.
4,762,067 A 8/1988 Barker et al.
4,776,393 A 10/1988 Forehand et al.
4,790,383 A 12/1988 Savage et al.
4,796,708 A 1/1989 Lembcke
4,800,815 A 1/1989 Appledorn et al.
4,830,120 A 5/1989 Stout
4,852,494 A 8/1989 Williams
4,869,171 A 9/1989 Abouav
4,889,183 A 12/1989 Sommers et al.
5,006,833 A 4/1991 Marlowe et al.
5,027,708 A 7/1991 Gonzalez et al.
5,038,682 A 8/1991 Marsden
5,050,691 A 9/1991 Moses
5,052,489 A 10/1991 Carisella et al.
5,060,573 A 10/1991 Montgomery et al.
5,088,413 A 2/1992 Huber
5,105,742 A 4/1992 Sumner
5,159,145 A 10/1992 Carisella et al.
5,159,146 A 10/1992 Carisella et al.
5,204,491 A 4/1993 Aureal et al.
5,322,019 A 6/1994 Hyland
5,347,929 A 9/1994 Lerche et al.
5,358,418 A 10/1994 Carmichael
5,392,851 A 2/1995 Arend
5,392,860 A 2/1995 Ross
5,436,791 A 7/1995 Turano et al.
5,503,077 A 4/1996 Motley
5,603,384 A 2/1997 Bethel et al.
5,647,444 A 7/1997 Williams
5,648,635 A 7/1997 Lussier et al.
5,671,899 A 9/1997 Nicholas et al.
5,703,319 A 12/1997 Fritz et al.
5,756,926 A 5/1998 Bonbrake et al.
5,775,426 A 7/1998 Snider et al.
5,778,979 A 7/1998 Burleson et al.
5,785,130 A 7/1998 Wesson et al.
5,797,761 A 8/1998 Ring
5,803,175 A 9/1998 Myers, Jr. et al.
5,816,343 A 10/1998 Markel et al.
5,820,402 A 10/1998 Chiacchio et al.
5,823,266 A 10/1998 Burleson et al.
5,837,925 A 11/1998 Nice
5,911,277 A 6/1999 Hromas et al.
5,964,294 A 10/1999 Edwards et al.
5,992,289 A 11/1999 George et al.
5,992,523 A 11/1999 Burleson et al.
6,006,833 A 12/1999 Burleson et al.
6,012,525 A 1/2000 Burleson et al.
6,050,353 A 4/2000 Logan et al.
6,082,450 A 7/2000 Snider et al.
6,112,666 A 9/2000 Murray et al.
6,158,532 A 12/2000 Logan et al.
6,196,325 B1 3/2001 Connell et al.
6,298,915 B1 10/2001 George
6,305,287 B1 10/2001 Capers et al.
6,333,699 B1 * 12/2001 Zierolf ..... E21B 17/006 705/65
6,354,374 B1 3/2002 Edwards et al.
6,385,031 B1 5/2002 Lerche et al.
6,386,108 B1 5/2002 Brooks et al.
6,408,758 B1 6/2002 Duguet
6,412,388 B1 7/2002 Frazier
6,412,415 B1 7/2002 Kothari et al.
6,418,853 B1 7/2002 Duguet et al.
6,419,044 B1 7/2002 Tite et al.

(56) References Cited

U.S. PATENT DOCUMENTS 6,439,121 B1 8/2002 Gillingham
6,467,415 B2 10/2002 Menzel et al.
6,474,931 B1 11/2002 Austin et al.
6,487,973 B1 12/2002 Gilbert, Jr. et al.
6,497,285 B2 12/2002 Walker
6,582,251 B1 6/2003 Burke et al.
6,618,237 B2 9/2003 Eddy et al.
6,651,747 B2 11/2003 Chen et al.
6,659,180 B2 12/2003 Moss
6,675,896 B2 1/2004 George
6,719,061 B2 4/2004 Muller et al.
6,739,265 B1 5/2004 Badger et al.
6,742,602 B2 6/2004 Trotechaud
6,752,083 B1 6/2004 Lerche et al.
6,779,605 B2 8/2004 Jackson
6,843,317 B2 1/2005 Mackenzie
6,851,471 B2 2/2005 Barlow et al.
7,013,977 B2 3/2006 Nordaas
7,044,230 B2 5/2006 Starr et al.
7,093,664 B2 8/2006 Todd et al.
7,107,908 B2 9/2006 Forman et al.
7,147,068 B2 12/2006 Vail, III
7,168,494 B2 1/2007 Starr et al.
7,182,625 B2 2/2007 Machado et al.
7,193,527 B2 3/2007 Hall
7,210,524 B2 5/2007 Sloan et al.
7,237,626 B2 7/2007 Gurjar et al.
7,243,722 B2 7/2007 Oosterling et al.
7,255,183 B2 8/2007 Cramer
7,278,491 B2 * 10/2007 Scott ..... E21B 43/119 166/380
7,306,038 B2 12/2007 Challacombe
7,347,278 B2 3/2008 Lerche et al.
7,347,279 B2 3/2008 Li et al.
7,350,448 B2 4/2008 Bell et al.
7,353,879 B2 4/2008 Todd et al.
7,357,083 B2 4/2008 Takahara et al.
7,360,487 B2 4/2008 Myers, Jr. et al.
7,364,451 B2 4/2008 Ring et al.
7,387,162 B2 6/2008 Mooney, Jr. et al.
7,441,601 B2 10/2008 George et al.
7,493,945 B2 2/2009 Doane et al.
7,510,017 B2 3/2009 Howell et al.
7,540,758 B2 6/2009 Ho
7,565,927 B2 7/2009 Gerez et al.
7,568,429 B2 8/2009 Hummel et al.
7,591,212 B2 9/2009 Myers, Jr. et al.
7,661,474 B2 2/2010 Campbell et al.
7,726,396 B2 6/2010 Briquet et al.
7,735,578 B2 6/2010 Loehr et al.
7,762,172 B2 7/2010 Li et al.
7,762,331 B2 7/2010 Goodman et al.
7,762,351 B2 7/2010 Vidal
7,775,279 B2 8/2010 Marya et al.
7,778,006 B2 8/2010 Stewart et al.
7,789,153 B2 9/2010 Prinz et al.
7,810,430 B2 10/2010 Chan et al.
7,901,247 B2 3/2011 Ring
7,908,970 B1 3/2011 Jakaboski et al.
7,913,603 B2 3/2011 LaGrange et al.
7,929,270 B2 4/2011 Hummel et al.
7,934,453 B2 5/2011 Moore
7,980,874 B2 7/2011 Finke et al.
D647,539 S 10/2011 Pruitt et al.
8,028,624 B2 10/2011 Mattson
8,066,083 B2 11/2011 Hales et al.
8,069,789 B2 12/2011 Hummel et al.
8,074,713 B2 12/2011 Ramos et al.
8,074,737 B2 12/2011 Hill et al.
8,091,477 B2 1/2012 Brooks et al.
8,127,846 B2 3/2012 Hill et al.
8,136,439 B2 3/2012 Bell
8,141,434 B2 3/2012 Kippersund et al.
8,151,882 B2 4/2012 Grigar et al.
8,157,022 B2 4/2012 Bertoja et al.
8,181,718 B2 5/2012 Burleson et al.
8,182,212 B2 5/2012 Parcell
8,186,259 B2 5/2012 Burleson et al.
8,230,788 B2 7/2012 Brooks et al.
8,256,337 B2 9/2012 Hill
8,336,437 B2 12/2012 Barlow et al.
8,388,374 B2 3/2013 Grek et al.
8,395,878 B2 3/2013 Stewart et al.
8,408,286 B2 4/2013 Rodgers et al.
8,413,727 B2 4/2013 Holmes
8,439,114 B2 5/2013 Parrott et al.
8,451,137 B2 5/2013 Bonavides et al.
8,468,944 B2 6/2013 Givens et al.
8,474,381 B2 7/2013 Streibich et al.
8,596,378 B2 12/2013 Mason et al.
8,661,978 B2 3/2014 Backhus et al.
8,678,666 B2 3/2014 Scadden et al.
8,695,506 B2 4/2014 Lanclos
D712,013 S 8/2014 Mather
8,807,003 B2 8/2014 Le et al.
8,833,441 B2 9/2014 Fielder et al.
8,863,665 B2 10/2014 DeVries et al.
8,869,887 B2 10/2014 Deere et al.
8,875,787 B2 11/2014 Tassaroli
8,875,796 B2 11/2014 Hales et al.
8,881,816 B2 11/2014 Glenn et al.
8,884,778 B2 11/2014 Lerche et al.
8,943,943 B2 2/2015 Tassaroli
8,960,093 B2 2/2015 Preiss et al.
8,960,288 B2 2/2015 Sampson
9,065,201 B2 6/2015 Borgfeld et al.
9,080,433 B2 7/2015 Lanclos et al.
9,145,763 B1 9/2015 Sites, Jr.
9,145,764 B2 9/2015 Burton et al.
9,181,790 B2 11/2015 Mace et al.
9,194,219 B1 11/2015 Hardesty et al.
9,206,675 B2 12/2015 Hales et al.
9,284,819 B2 3/2016 Tolman et al.
9,284,824 B2 3/2016 Fadul et al.
9,317,038 B2 4/2016 Ozick et al.
9,359,863 B2 6/2016 Streich et al.
9,383,237 B2 7/2016 Wiklund et al.
9,441,465 B2 9/2016 Tassaroli
9,476,289 B2 10/2016 Wells
9,494,021 B2 11/2016 Parks et al.
9,523,265 B2 12/2016 Upchurch et al.
9,523,271 B2 12/2016 Bonavides et al.
9,562,421 B2 2/2017 Hardesty et al.
9,581,422 B2 2/2017 Preiss et al.
9,587,439 B2 3/2017 Lamik-Thonhauser et al.
9,593,548 B2 3/2017 Hill et al.
9,598,942 B2 3/2017 Wells et al.
9,605,937 B2 3/2017 Eitschberger et al.
D783,133 S 4/2017 Fitzhugh et al.
9,617,814 B2 4/2017 Seals et al.
9,677,363 B2 6/2017 Schacherer et al.
9,689,223 B2 6/2017 Schacherer et al.
9,702,211 B2 7/2017 Tinnen
9,702,680 B2 * 7/2017 Parks ..... E21B 43/11855
9,709,373 B2 7/2017 Hikone et al.
9,784,549 B2 10/2017 Eitschberger
D807,991 S 1/2018 Fitzhugh
9,903,192 B2 2/2018 Entchev et al.
9,926,750 B2 3/2018 Ringgenberg
10,066,921 B2 9/2018 Eitschberger
10,072,783 B2 9/2018 Gledhill et al.
10,077,641 B2 9/2018 Rogman et al.
D833,581 S 11/2018 Atwell et al.
10,138,713 B2 11/2018 Tolman et al.
10,151,152 B2 12/2018 Wight et al.
10,151,180 B2 12/2018 Robey et al.
10,188,990 B2 1/2019 Burmeister et al.
10,190,398 B2 1/2019 Goodman et al.
10,337,270 B2 7/2019 Carisella et al.
10,352,136 B2 7/2019 Goyeneche
10,352,144 B2 7/2019 Entchev et al.
10,428,595 B2 10/2019 Bradley et al.
10,429,161 B2 10/2019 Parks et al.
10,458,213 B1 10/2019 Eitschberger et al.

(56) References Cited

U.S. PATENT DOCUMENTS 10,472,901 B2 11/2019 Engel et al.
10,472,938 B2 11/2019 Parks et al.
10,597,979 B1 3/2020 Eitschberger
D892,278 S 8/2020 Eitschberger
10,794,159 B2 10/2020 Eitschberger et al.
10,844,697 B2 11/2020 Preiss et al.
D904,475 S 12/2020 Preiss et al.
D921,858 S 6/2021 Eitschberger
11,021,923 B2 6/2021 Mulhern
11,480,038 B2 10/2022 Eitschberger
D968,474 S 11/2022 Volberg
11,591,885 B2 2/2023 Eitschberger
11,697,980 B2 * 7/2023 Goyeneche ..... F42B 3/02 175/4.57
2002/0020320 A1 2/2002 Lebaudy et al.
2002/0062991 A1 5/2002 Farrant et al.
2003/0000411 A1 1/2003 Cernocky et al.
2003/0001753 A1 1/2003 Cernocky et al.
2004/0141279 A1 7/2004 Amano et al.
2004/0211862 A1 10/2004 Elam
2004/0216866 A1 * 11/2004 Barlow ..... E21B 43/119 166/55
2005/0178282 A1 8/2005 Brooks et al.
2005/0183610 A1 8/2005 Barton et al.
2005/0186823 A1 8/2005 Ring et al.
2005/0194146 A1 9/2005 Barker et al.
2005/0229805 A1 10/2005 Myers, Jr. et al.
2005/0257710 A1 11/2005 Monetti et al.
2005/0279513 A1 12/2005 Eppink
2007/0084336 A1 4/2007 Neves
2007/0125540 A1 6/2007 Gerez et al.
2007/0158071 A1 7/2007 Mooney, Jr. et al.
2008/0029302 A1 2/2008 Scott
2008/0047456 A1 2/2008 Li et al.
2008/0047716 A1 2/2008 McKee et al.
2008/0110612 A1 5/2008 Prinz et al.
2008/0134922 A1 6/2008 Grattan et al.
2008/0149338 A1 6/2008 Goodman et al.
2008/0173204 A1 7/2008 Anderson et al.
2008/0173240 A1 7/2008 Furukawahara et al.
2008/0264639 A1 10/2008 Parrott et al.
2009/0050322 A1 2/2009 Hill et al.
2009/0159285 A1 6/2009 Goodman
2009/0272519 A1 11/2009 Green et al.
2009/0272529 A1 11/2009 Crawford
2009/0301723 A1 12/2009 Gray
2010/0000789 A1 1/2010 Barton et al.
2010/0012774 A1 1/2010 Fanucci et al.
2010/0024674 A1 2/2010 Peeters et al.
2010/0089643 A1 4/2010 Vidal
2010/0096131 A1 4/2010 Hill et al.
2010/0107917 A1 5/2010 Moser
2010/0163224 A1 7/2010 Strickland
2010/0230104 A1 9/2010 Nölke et al.
2011/0024116 A1 2/2011 McCann et al.
2011/0042069 A1 2/2011 Bailey et al.
2011/0100627 A1 5/2011 Hales et al.
2011/0301784 A1 12/2011 Oakley et al.
2012/0006217 A1 1/2012 Anderson
2012/0085538 A1 4/2012 Guerrero et al.
2012/0094553 A1 4/2012 Fujiwara et al.
2012/0160483 A1 6/2012 Carisella
2012/0199031 A1 8/2012 Lanclos
2012/0199352 A1 8/2012 Lanclos et al.
2012/0241169 A1 9/2012 Hales et al.
2012/0242135 A1 9/2012 Thomson et al.
2012/0247769 A1 10/2012 Schacherer et al.
2012/0247771 A1 10/2012 Black et al.
2012/0298361 A1 11/2012 Sampson
2013/0008639 A1 1/2013 Tassaroli et al.
2013/0008669 A1 1/2013 Deere et al.
2013/0037255 A1 2/2013 Kash et al.
2013/0043074 A1 2/2013 Tassaroli
2013/0062055 A1 3/2013 Tolman et al.
2013/0112396 A1 5/2013 Splittstoeßer
2013/0118342 A1 5/2013 Tassaroli
2013/0199843 A1 8/2013 Ross
2013/0248174 A1 9/2013 Dale et al.
2013/0256464 A1 10/2013 Belik et al.
2014/0033939 A1 2/2014 Priess et al.
2014/0053750 A1 2/2014 Lownds et al.
2014/0131035 A1 5/2014 Entchev et al.
2014/0148044 A1 5/2014 Balcer et al.
2015/0075783 A1 3/2015 Angman et al.
2015/0176386 A1 6/2015 Castillo et al.
2015/0226044 A1 8/2015 Ursi et al.
2015/0308208 A1 10/2015 Capps et al.
2015/0330192 A1 11/2015 Rogman et al.
2016/0040509 A1 * 2/2016 Castillo ..... E21B 17/028 166/244.1
2016/0040520 A1 2/2016 Tolman et al.
2016/0061572 A1 3/2016 Eitschberger et al.
2016/0069163 A1 3/2016 Tolman et al.
2016/0084048 A1 3/2016 Harrigan et al.
2016/0168961 A1 * 6/2016 Parks ..... E21B 43/1185 102/306
2016/0273902 A1 * 9/2016 Eitschberger ..... F42D 1/05
2016/0333675 A1 11/2016 Wells et al.
2017/0030693 A1 2/2017 Preiss et al.
2017/0052011 A1 2/2017 Parks et al.
2017/0145798 A1 5/2017 Robey et al.
2017/0211363 A1 7/2017 Bradley et al.
2017/0241244 A1 8/2017 Barker et al.
2017/0268860 A1 9/2017 Eitschberger
2017/0314372 A1 11/2017 Tolman et al.
2018/0030334 A1 2/2018 Collier et al.
2018/0087330 A1 3/2018 Bradley et al.
2018/0135398 A1 5/2018 Entchev et al.
2018/0202789 A1 7/2018 Parks et al.
2018/0202790 A1 7/2018 Parks et al.
2018/0209251 A1 7/2018 Robey et al.
2018/0274342 A1 9/2018 Sites
2018/0299239 A1 10/2018 Eitschberger et al.
2018/0318770 A1 11/2018 Eitschberger et al.
2019/0040722 A1 2/2019 Yang et al.
2019/0048693 A1 2/2019 Henke et al.
2019/0049225 A1 2/2019 Eitschberger
2019/0085685 A1 3/2019 McBride
2019/0153827 A1 5/2019 Goyeneche
2019/0162056 A1 5/2019 Sansing
2019/0195054 A1 6/2019 Bradley et al.
2019/0211655 A1 7/2019 Bradley et al.
2019/0219375 A1 7/2019 Parks et al.
2019/0257158 A1 * 8/2019 Langford ..... E21B 17/043
2019/0257181 A1 8/2019 Langford et al.
2019/0284889 A1 9/2019 LaGrange et al.
2019/0292887 A1 9/2019 Austin, II et al.
2019/0316449 A1 10/2019 Schultz et al.
2019/0330947 A1 10/2019 Mulhern et al.
2020/0032626 A1 1/2020 Parks et al.
2020/0063537 A1 2/2020 Langford et al.
2020/0199983 A1 6/2020 Preiss et al.
2020/0362652 A1 11/2020 Eitschberger et al.
2020/0362654 A1 11/2020 Eitschberger et al.
2020/0362676 A1 11/2020 Goyeneche
2020/0378731 A1 12/2020 Mcnelis
2020/0386060 A1 12/2020 Sullivan et al.
2020/0399995 A1 12/2020 Preiss et al.
2022/0178230 A1 6/2022 Eitschberger
2022/0307330 A1 9/2022 Eitschberger
2022/0403718 A1 12/2022 Eitschberger
2023/0016759 A1 1/2023 Eitschberger

FOREIGN PATENT DOCUMENTS

CA 2824838 A1 2/2015
CA 2941648 A1 9/2015
CA 2888787 A1 10/2015
CA 2980935 A1 10/2016
CA 3040116 A1 10/2016
CA 3022946 A1 11/2017
CA 3021913 A1 2/2018
CA 3050712 A1 7/2018
CA 2980935 C 11/2019

(56) References Cited

FOREIGN PATENT DOCUMENTS

| | | | |
|---|---|---|---|
| CN | 85107897 | A | 9/1986 |
| CN | 1082601 | C | 4/2002 |
| CN | 2661919 | | 12/2004 |
| CN | 2821154 | | 9/2006 |
| CN | 201209435 | | 3/2009 |
| CN | 101397890 | A | 4/2009 |
| CN | 101691837 | B | 4/2010 |
| CN | 201507296 | U | 6/2010 |
| CN | 101892822 | B | 11/2010 |
| CN | 201620848 | U | 11/2010 |
| CN | 201764910 | U | 3/2011 |
| CN | 202431259 | U | 9/2012 |
| CN | 102878877 | A | 1/2013 |
| CN | 103485750 | A | 1/2014 |
| CN | 103993861 | A | 8/2014 |
| CN | 204430910 | U | 7/2015 |
| CN | 207847603 | U | 9/2018 |
| CN | 208347755 | U | 1/2019 |
| CN | 208870580 | U | 5/2019 |
| CN | 209195374 | U | 8/2019 |
| CN | 110424930 | A | 11/2019 |
| CN | 106522886 | B | 12/2019 |
| CN | 209908471 | U | 1/2020 |
| DE | 102007007498 | | 10/2015 |
| EP | 0416915 | A2 | 3/1991 |
| EP | 0180520 | B1 | 5/1991 |
| EP | 679859 | A2 | 11/1995 |
| EP | 0482969 | B1 | 8/1996 |
| EP | 0721051 | A3 | 4/1998 |
| EP | 694157 | B1 | 8/2001 |
| EP | 2702349 | B1 | 11/2015 |
| EP | 2310616 | B1 | 10/2017 |
| GB | 839486 | A | 6/1960 |
| GB | 2531450 | B | 2/2017 |
| JP | 1363909 | | 5/2009 |
| JP | 1387855 | | 4/2010 |
| RU | 2175379 | C2 | 10/2001 |
| RU | 2295694 | C2 | 3/2007 |
| RU | 93521 | U1 | 4/2010 |
| RU | 100552 | U1 | 12/2010 |
| RU | 2434122 | C2 | 11/2011 |
| RU | 2633904 | C1 | 10/2017 |
| WO | 8802056 | A1 | 3/1988 |
| WO | 9905390 | A1 | 2/1999 |
| WO | 2000020821 | A1 | 4/2000 |
| WO | 0133029 | A3 | 5/2001 |
| WO | 0159401 | A1 | 8/2001 |
| WO | 2001059401 | A1 | 8/2001 |
| WO | 2008098052 | A3 | 10/2008 |
| WO | 2009091422 | A2 | 7/2009 |
| WO | 2009091422 | A3 | 3/2010 |
| WO | 2011051435 | A2 | 5/2011 |
| WO | 2012006357 | A2 | 1/2012 |
| WO | 2012106640 | A3 | 11/2012 |
| WO | 2012149584 | A1 | 11/2012 |
| WO | 2014046670 | A1 | 3/2014 |
| WO | 2014089194 | A1 | 6/2014 |
| WO | 2015006869 | A1 | 1/2015 |
| WO | 2015028204 | A2 | 3/2015 |
| WO | 2015134719 | A1 | 9/2015 |
| WO | 2016100269 | A1 | 6/2016 |
| WO | 2017147329 | A1 | 8/2017 |
| WO | 2017192878 | A1 | 11/2017 |
| WO | 2018009223 | A1 | 1/2018 |
| WO | 2018057934 | A1 | 3/2018 |
| WO | 2018136808 | A1 | 7/2018 |
| WO | 2018182565 | A1 | 10/2018 |
| WO | 2018213768 | A1 | 11/2018 |
| WO | 2019117861 | A1 | 6/2019 |
| WO | 2019148009 | A2 | 8/2019 |
| WO | 2019165286 | A1 | 8/2019 |
| WO | 2019204137 | A1 | 10/2019 |
| WO | 2020016644 | A1 | 1/2020 |
| WO | 2020035616 | A1 | 2/2020 |
| WO | 2020232242 | A1 | 11/2020 |
| WO | 2020244895 | A1 | 12/2020 |

OTHER PUBLICATIONS

United States Patent Trial and Appeal Board; Institution Decision for PGR 2020-00080; dated Feb. 12, 2021; 15 pages.

Vigor USA; "Sniper Addressable System"; promotional brochure; Sep. 2019.

Vigor,Perforating Gun Accessories,China Vigor Drilling Oil Tools And Equipment Co.,Ltd., Sep. 14, 2018, 4 pgs., http://www.vigordrilling.com/completion-tools/perforating-gun-accessories.html.

United States Patent and Trademark Office; Non-Final Office Action for U.S. Appl. No. 17/181,280; dated Apr. 19, 2021; 18 pages.

United States Patent and Trademark Office; Notice of Allowance for U.S. Appl. No. 17/181,280; dated Sep. 15, 2021; 14 pages.

International Searching Authority; International Preliminary Report on Patentability of the International Searching Authority for PCT/EP2021/057148; mailed on Sep. 29, 2022; 8 pages.

United States Patent and Trademark Office; Requirement for Restriction/Election for U.S. Appl. No. 29/735,905; dated Dec. 28, 2023; 14 pages.

China National Intellectual Property Administration; First Notification of Rectification for CN Application No. 202030558962.5 dated Jan. 22, 2021; 1 page.

Dynaenergetics Europe; Complaint and Demand for Jury Trial, Civil Action No. 1:20-cv-03665; dated Dec. 15, 2020; 8 pages.

Dynaenergetics Europe; Complaint and Demand for Jury Trial, Civil Action No. 6:20-cv-00069; dated Jan. 30, 2020; 9 pages.

Dynaenergetics Europe; Complaint and Demand for Jury Trial, Civil Action No. 6:20-cv-01110; dated Dec. 4, 2020; 15 pages.

Dynaenergetics Europe; Complaint and Demand for Jury Trial, Civil Action No. 6:20-cv-01201; dated Dec. 30, 2020; 12 pages.

Dynaenergetics Europe; Complaint and Demand for Jury Trial, Civil Action No. 4:17-cv-03784; dated Dec. 14, 2017; 7 pages.

Dynaenergetics Europe; Plaintiffs' Motion to Dismiss Defendants' Counterclaim and to strike Affirmative Defenses, Civil Action No. 4:17-cv-03784; dated Feb. 20, 2018; 10 pages.

Jet Research Center Inc., JRC Catalog, 2008, 36 pgs., https://www.jetresearch.com/content/dam/jrc/Documents/Books_Catalogs/06_Dets.pdf.

Jet Research Center Inc., Red RF Safe Detonators Brochure, 2008, 2 pages, www.jetresearch.com.

Jet Research Center, Velocity™ Perforating System Plug and Play Guns For Pumpdown Operation, Ivarado, Texas, Jul. 2019, 8 pgs., https://www.jetresearch.com/content/dam/jrc/Documents/Brochures/jrc-velocity-perforating-system.pdf.

Johnson, Bryce; Rule 501 citation of prior art and written "claim scope statements" in U.S. Pat. No. 10,844,697; dated Apr. 29, 2021; 18 pages.

OSO Perforating; "OsoLite"; promotional brochure; Jan. 2019.

Owen Oil Tools & Pacific Scientific; RF-Safe Green Det, Side Block for Side Initiation, Jul. 26, 2017, 2 pgs.

Owen Oil Tools, E & B Select Fire Side Port, Tandem Sub, Apr. 2010, 2 pgs., https://www.corelab.com/owen/cms/docs/Canada/10A_eandbsystem-01.0-c.pdf.

Owen Oil Tools, Expendable Perforating Guns, Jul. 2008, 7 pgs., https://www.corelab.com/owen/cms/docs/Canada/10A_erhsc-01.0-c.pdf.

Owen Oil Tools, Recommended Practice for Oilfield Explosive Safety, Presented at 2011 MENAPS Middle East and North Africa Perforating Symposium, Nov. 28-30, 2011, 6 pages.

Owens Oil Tools, E & B Select Fire Side Port Tandem Sub Assembly, 2009, 9 pgs., https://www.corelab.com/owen/CMS/docs/Manuals/gunsys/MAN-30-XXX-0002-96-R00.pdf.

Parrot, Robert; Declaration, PGR 2020-00080; dated Aug. 11, 2020; 400 pages.

Parrott, Robert; Declaration for IPR2021-00082; dated Oct. 20, 2020; 110 pages.

(56) References Cited

OTHER PUBLICATIONS

Parrott, Robert; Declaration for PGR No. 2021-00078; dated May 10, 2021; 182 pages.
Robert Parrott, Case IPR2018-00600 for U.S. Pat. No. 9,581,422 B2, Declaration regarding Patent Invalidity, dated Jun. 29, 2020, 146 pages.
Rodgers, John; Declaration for PGR2020-00072; dated Oct. 23, 2020; 116 pages.
Rodgers, John; Declaration for PGR2020-00080; dated Nov. 18, 2020; 142 pages.
Salt Warren et al.; New Perforating Gun System Increases Safety and Efficiency; dated Apr. 1, 2016; 11 pages.
Scharf Thilo; Declaration for PGR2020-00080; dated Nov. 16, 2020; 16 pages.
Scharf, Thilo; Declaration for PGR2020-00072; dated Oct. 22, 2020; 13 pages.
Schlumberger & Said Abubakr, Combining and Customizing Technologies for Perforating Horizontal Wells in Algeria, Presented at 2011 MENAPS, Nov. 28-30, 2011, 20 pages.
Smylie, Tom, New Safe and Secure Detonators for the Industry's consideration, presented at Explosives Safety & Security Conference, Marathon Oil Co, Houston; Feb. 23-24, 2005, 20 pages.
SWM International Inc.; "Thunder Disposable Gun System"; promotional brochure; Oct. 2018; 5 pgs.
Thilo Scharf; "DynaEnergetics exhibition and product briefing"; pp. 5-6; presented at 2014 Offshore Technology Conference; May 2014.
Thilo Scharf; "DynaStage & BTM Introduction"; pp. 4-5, 9; presented at 2014 Offshore Technology Conference; May 2014.
U.S. Patent Trial and Appeal Board, Institution of Inter Partes Review of U.S. Pat. No. 9,581,422, Case IPR2018-00600, Aug. 21, 2018, 9 pages.
United States District Court for the Southern District of Texas Houston Division, Case 4:19-cv-01611 for U.S. Pat. No. 9,581,422 B2, Plaintiff's Complaint and Exhibits, dated May 2, 2019, 26 pgs.
United States District Court for the Southern District of Texas Houston Division, Case 4:19-cv-01611 for U.S. Pat. No. 9,581,422 B2, Defendant's Answers, Counterclaims and Exhibits, dated May 28, 2019, 135 pgs.
United States District Court for the Southern District of Texas Houston Division, Case 4:19-cv-01611 for U.S. Pat. No. 9,581,422 B2, Plaintiffs' Motion to Dismiss and Exhibits, dated Jun. 17, 2019, 63 pgs.
United States Patent and Trademark Office, Case IPR2018-00600 for U.S. Pat. No. 9,581,422 B2, Reply In Support of Patent Owner's Motion to Amend, dated Mar. 21, 2019, 15 pgs.
United States Patent and Trademark Office, Case IPR2018-00600 for U.S. Pat. No. 9,581,422 B2, Decision of Precedential Opinion Panel, Granting Patent Owner's Request for Hearing and Granting Patent Owner's Motion to Amend, dated Jul. 6, 2020, 27 pgs.
United States Patent and Trademark Office, Case IPR2018-00600 for U.S. Pat. No. 9,581,422 B2, DynaEnergetics GmbH & Co. KG's Patent Owner Preliminary Response, dated May 22, 2018, 47 pgs.
United States Patent and Trademark Office, Case IPR2018-00600 for U.S. Pat. No. 9,581,422 B2, Order Granting Precedential Opinion Panel, Paper No. 46, dated Nov. 7, 2019, 4 pgs.
United States Patent and Trademark Office, Case IPR2018-00600 for U.S. Pat. No. 9,581,422 B2, Patent Owner's Motion to Amend, dated Dec. 6, 2018, 53 pgs.
United States Patent and Trademark Office, Case IPR2018-00600 for U.S. Pat. No. 9,581,422 B2, Patent Owner's Opening Submission to Precedential Opinion Panel, dated Dec. 20, 2019, 21 pgs.
United States Patent and Trademark Office, Case IPR2018-00600 for U.S. Pat. No. 9,581,422 B2, Patent Owner's Request for Hearing, dated Sep. 18, 2019, 19 pgs.
United States Patent and Trademark Office, Case IPR2018-00600 for U.S. Pat. No. 9,581,422 B2, Patent Owner's Responsive Submission to Precedential Opinion Panel, dated Jan. 6, 2020, 16 pgs.
United States Patent and Trademark Office, Case IPR2018-00600 for U.S. Pat. No. 9,581,422 B2, Patent Owner's Sur-reply, dated Mar. 21, 2019, 28 pgs.
United States Patent and Trademark Office, Case IPR2018-00600 for U.S. Pat. No. 9,581,422 B2, Petitioner's Additional Briefing to the Precedential Opinion Panel, dated Dec. 20, 2019, 23 pgs.
United States Patent and Trademark Office, Case IPR2018-00600 for U.S. Pat. No. 9,581,422 B2, Petitioner's Opposition to Patent Owner's Motion to Amend, dated Mar. 7, 2019, 30 pgs.
United States Patent and Trademark Office, Case IPR2018-00600 for U.S. Pat. No. 9,581,422 B2, Petitioner's Reply Briefing to the Precedential Opinion Panel, dated Jan. 6, 2020, 17 pgs.
United States Patent and Trademark Office, Case IPR2018-00600 for U.S. Pat. No. 9,581,422 B2, Petitioner's Reply in Inter Partes Review of Patent No. 9,581,422, dated Mar. 7, 2019, 44 pgs.
United States Patent and Trademark Office, Final Written Decision of Case IPR2018-00600 for U.S. Pat. No. 9,581,422 B2, Paper No. 42, dated Aug. 20, 2019, 31 pgs.
United States Patent and Trademark Office; Non-Final Office Action for U.S. Appl. No. 17/007,574; dated Jan. 29, 2021; 11 pages.
United States Patent and Trademark Office; Non-Final Office Action for U.S. Appl. No. 17/221,219; dated Jun. 17, 2021; 10 pages.
United States Patent and Trademark Office; Patent Prosecution History of U.S. Appl. No. 61/733,129; dated Jan. 3, 2013; 22 pages.
United States Patent and Trademark Office; Patent Prosecution History U.S. Appl. No. 61/439,217; dated Mar. 4, 2011; 31 pages.
United States Patent and Trademark Office; U.S. Appl. No. 62/002,559; dated May 23, 2014; 19 pages.
United States Patent and Trademark Office; U.S. Appl. No. 62/002,565; dated Jun. 25, 2014; 25 pages.
United States Patent and Trial Appeal Board; Final Written Decision on IPR2018-00600; issued Aug. 20, 2019; 31 pages.
United States Patent Trial and Appeal Board; Decision Denying Institution of Post-Grant Review; PGR No. 2020-00072; dated Jan. 19, 2021; 38 pages.
Amit Govil, Selective Perforation: A Game Changer in Perforating Technology—Case Study, presented at the 2012 European and West African Perforating Symposium, Schlumberger, Nov. 7-9, 2012, 14 pgs.
Austin Powder Company; A-140 F & Block, Detonator & Block Assembly; Jan. 5, 2017; 2 pgs.; https://www.austinpowder.com/wp-content/uploads/2019/01/OilStar_A140Fbk-2.pdf.
Baker Hughes, Long Gun Deployment Systems IPS-12-28; 2012 International Perforating Symposium; Apr. 26-27, 2011; 11 pages.
Baker Hughes; SurePerf Rapid Select-Fire System Perforate production zones in a single run; 2012; 2 pages.
Brazilian Patent and Trademark Office; Search Report for BR Application No. BR112015033010-0; mailed May 5, 2020; (4 pages).
Buche & Associates, P.C.; Rule 501 Citation of Prior Art and Written "Claim Scope Statements" in U.S. Pat. No. 10,844,697; dated Mar. 3, 2021; 24 pages.
Burndy, Bulkhead Ground Connector, Mechanical Summary Sheet, The Grounding Superstore, Jul. 15, 2014, 1 page, https://www.burndy.com/docs/default-source/cutsheets/bulkhead-connect.
C&J Energy Services; Gamechanger Perforating System Description; 2018; 1 pages.
C&J Energy Services; Gamechanger Perforating System Press Release; 2018; 4 pages.
Canadian Intellectual Property Office, Office Action for CA App. No. 2923860 dated Jul. 14, 2017, 3 pages.
Core Lab, ZERO180™ Gun SystemAssembly and Arming Procedures, 2015, 33 pgs., https://www.corelab.com/owen/CMS/docs/Manuals/gunsys/zero180/MAN-Z180-000.pdf.
CoreLab Quick Change Assembly; Exhibit No. 1034 of PGR No. 2021-00078; dated Aug. 2002; 1 page.
Dynaenergetics Europe GMBH; Patent Owner's Preliminary Response for PGR2020-00072; dated Oct. 23, 2020; 108 pages.
Dynaenergetics Europe GMBH; Patent Owner's Preliminary Response for PGR2020-00080; dated Nov. 18, 2020; 119 pages.
Dynaenergetics Europe GMBH; Principal and Response Brief of Cross-Appellant for United States Court of Appeals case No. 2020-2163, -2191; dated Jan. 11, 2021; 95 pages.
Dynaenergetics Europe; Defendants' Preliminary Infringement Contentions for Civil Action No. 3:20-CV-00376; dated Mar. 25, 2021; 22 pages.

(56) References Cited

OTHER PUBLICATIONS

Dynaenergetics Europe; Exhibit B Invalidity Claim Chart for Civil Action No. 4:19-cv-01611; dated May 2, 2019; 52 pages.
Dynaenergetics Europe; Exhibit C Invalidity Claim Chart for Civil Action No. 4:17-cv-03784; dated Jul. 13, 2020; 114 pages.
Dynaenergetics Europe; Patent Owner's Preliminary Response for PGR No. 2020-00080; dated Nov. 18, 2020; 119 pages.
Dynaenergetics Europe; Plaintiffs' Local Patent Rule 3-1 Infringement Contentions for Civil Action No. 4:19-cv-01611; dated May 25, 2018; 10 Pages.
Dynaenergetics Europe; Plaintiffs' Preliminary Claim Constructions and Identification of Extrinsic Evidence Civil Action No. 4:17-cv-03784; dated Aug. 3, 2018; 9 pages.
Dynaenergetics Europe; Plaintiffs' Preliminary Infringement Contentions, Civil Action No. 6:20-cv-00069-ADA; dated Apr. 22, 2020; 32 pages.
Dynaenergetics Europe; Plaintiffs' Reply in Support of Motion to Dismiss and Strike for Civil Action No. 6:20-cv-00069-ADA; dated Apr. 29, 2020; 15 pages.
DynaEnergetics exhibition and product briefing; Exhibit 2006 of PGR No. 2020-00072; dated 2013; 15 pages.
Dynaenergetics GMBH & Co. KG, Patent Owner's Response to Hunting Titan's Petition for Inter Parties Review—Case IPR2018-00600, filed Dec. 6, 2018, 73 pages.
Dynaenergetics GmbH & Co. KG; Patent Owner's Precedential Opinion Panel Request for Case IPR2018-00600; Sep. 18, 2019, 2 pg.
Dynaenergetics, DYNAselect Electronic Detonator 0015 SFDE RDX 1.4B, Product Information, Dec. 16, 2011, 1 pg.
Dynaenergetics, DYNAselect Electronic Detonator 0015 SFDE RDX 1.4S, Product Information, Dec. 16, 2011, 1 pg.
Dynaenergetics, DYNAselect System, information downloaded from website, Jul. 3, 2013, 2 pages, http://www.dynaenergetics.com/.
Dynaenergetics, Electronic Top Fire Detonator, Product Information Sheet, Jul. 30, 2013, 1 pg.
Dynaenergetics, Gun Assembly, Product Summary Sheet, May 7, 2004, 1 page.
Dynaenergetics, Selective Perforating Switch, information downloaded from website, Jul. 3, 2013, 2 pages, http://www.dynaenergetics.com/.
Dynaenergetics, Selective Perforating Switch, Product Information Sheet, May 27, 2011, 1 pg.
DynaStage Gun System; Exhibit 2009 of PGR No. 2020-00080; dated May 2014; 2 pages.
Eric H. Findlay, Jury Trial Demand in Civil Action No. 6:20-cv-00069-ADA, dated Apr. 22, 2020, 32 pages.
GeoDynamics; "STRATX"; promotional brochure; Jan. 30, 2020.
GeoDynamics; "VaporGun"; promotional brochure; Mar. 4, 2020.
GeoDynamics; "Vapr"; promotional brochure; Oct. 1, 2019.
Gilliat et al.; New Select-Fire System: Improved Reliability and Safety in Select Fire Operations; 2012; 16 pgs.
Horizontal Wireline Services, Presentation of a completion method of shale demonstrated through an example of Marcellus Shale, Pennsylvania, USA, Presented at 2012 International Perforating Symposium (Apr. 26-28, 2012), 17 pages.
Hunting Energy Services Pte Ltd., "H-1 Perforating Gun System"; promotional brochure; Jun. 21, 2019.
Hunting Energy Services Pte Ltd., "H-2 Perforating System"; promotional brochure; Feb. 12, 2020.
Hunting Titan Inc.; Petition for Post Grant Review of U.S. Pat. No. 10,429,161; dated Jun. 30, 2020; 109 pages.
Hunting Titan Inc.; Petition for Post Grant Review of U.S. Pat. No. 10,472,938; dated Aug. 12, 2020; 198 pages.
Hunting Titan Ltd.; Petition for Inter Partes Review of U.S. Pat. No. 9,581,422 Case No. IPR2018-00600; dated Feb. 16, 2018; 93 pages.
Hunting Titan Ltd.; Defendants Invalidity Contentions Pursuant to Patent Rule 3-3, Civil Action No. 4:17-cv-03784; dated Jul. 6, 2018; 29 pages.
Hunting Titan, H-1® Perforating Gun System, 2016, 2 pgs., http://www.hunting-intl.com/titan.
Hunting Titan, Inc., U.S. Appl. No. 62/627,591 titled Cluster Gun System and filed Feb. 7, 2018, which is a priority application of International App. No. PCT/US2019/015255 published as WO2019/148009, Aug. 1, 2019, 7 pages, WIPO.
Hunting Titan, Wireline Top Fire Detonator Systems, Nov. 24, 2014, 2 pgs, http://www.hunting-intl.com/titan/perforating-guns-and-setting-tools/wireline-top-fire-detonator-systems.
International Searching Authority; International Search Report and Written Opinion of the International Searching Authority for PCT/EP2021/057148; mailed on Jul. 5, 2021; 11 pages.

* cited by examiner

ADAPTER ASSEMBLY FOR USE WITH A WELLBORE TOOL STRING

CROSS-REFERENCE TO RELATED APPLICATIONS

This application is a continuation of U.S. patent application Ser. No. 17/545,147 filed Dec. 8, 2021, which is a continuation of U.S. patent application Ser. No. 17/181,280 filed Feb. 22, 2021, which is a continuation-in-part of U.S. Design patent application No. 29/735,905, filed May 26, 2020 and claims priority to U.S. Provisional Application No. 62/992,643 filed Mar. 20, 2020, the contents of each of which are incorporated herein by reference.

BACKGROUND

Wellbore tools used in oil and gas operations are often sent down a wellbore in tool strings including multiple discrete wellbore tools, or modules, connected together to consolidate different or multiple wellbore operations into a single "run," or process of sending wellbore tools downhole to perform one or more operations. This approach contributes to time and cost savings because preparing and deploying a wellbore tool into a wellbore and pumping, with fluid under hydraulic pressure, the wellbore tool to a particular location in a wellbore (that may be a mile or more under the ground) requires a great deal of time, energy, and manpower. Additional time, manpower, and costs are required to conduct the operation and remove the spent wellbore tool(s) from the wellbore.

Wellbore tools may include, without limitation, perforating guns, puncher guns, logging tools, jet cutters, plugs, frac plugs, bridge plugs, setting tools, self-setting bridge plugs, self-setting frac plugs, mapping/positioning/orientating tools, bailer/dump bailer tools and ballistic tools. Many of these wellbore tools contain sensitive or powerful explosives because many wellbore tools are ballistically (i.e., explosively) actuated or perform ballistic operations within the wellbore. Additionally, certain wellbore tools may include sensitive electronic control components and connections that control various operations of the wellbore tool. Explosives, control systems, and other components of wellbore tools may be sensitive to conditions within the wellbore including the high pressures and temperatures, fluids, debris, etc. In addition, wellbore tools that have explosive activity may generate tremendous amounts of ballistic and gas pressures within the wellbore tool itself. Accordingly, to ensure the integrity and proper operation of wellbore tools connected together as part of the tool string, connections between adjacent wellbore tools within the tool string may not only connect adjacent wellbore tools in the tool string, they may, in many cases, seal internal components of the wellbore tools from the wellbore conditions and pressure isolate adjacent modules against ballistic forces.

A tandem seal adapter (TSA) is a known connector often used for accomplishing the functions of a connector as described above, and in particular for connecting adjacent perforating gun modules. A perforating gun is an exemplary, though not limiting, wellbore tool that may include many of the features and challenges described above. A perforating gun carries explosive charges into the wellbore to perform perforating operations by which the shaped charges are detonated in a manner that produces perforations in a surrounding geological hydrocarbon formation from which oil and gas may be recovered. Conventional perforating guns often include electric componentry to control positioning and detonation of the explosive charges.

In conventional systems, problems may arise in that the mechanical coupling between consecutive wellbore tools has insufficient strength. Additionally, conventional connectors may undesirably increase the length of the wellbore tool string. For example, a conventional connector may include both sealing elements and mechanical coupling components on the same part. However, as the sealing elements and coupling components must be axially separated, this increases the overall axial length of the connector, which in turn increases the length of the tool string.

Accordingly, it may be desirable to develop a tandem seal adapter, adapter assembly, and wellbore tool string that helps to strength mechanical coupling between components, shortens the length of the tool string, and may be produced more efficiently and inexpensively.

BRIEF DESCRIPTION

An exemplary embodiment of an adapter assembly for use with a wellbore tool string may include a tandem seal adapter (TSA) and a collar. The TSA may include a TSA body extending along an axial direction. The collar may include a collar body, a first collar coupling, and a second collar coupling. The collar body may be formed in a substantially annular shape and extend in the axial direction. The collar may be provided outward from the TSA in a radial direction substantially perpendicular to the axial direction. The first collar coupling and the second collar coupling may be provided on an interior surface of the collar body. The second collar coupling may be axially displaced from the first collar coupling. The TSA body and the collar body overlap in the axial direction. The first collar coupling and the TSA may define a first space configured to receive an end of a first housing of a first wellbore tool. The second collar coupling and the TSA may define a second space configured to receive an end of a second housing of a second wellbore tool.

An exemplary embodiment of an adapter assembly for use with a wellbore tool string may include a tandem seal adapter (TSA) and a collar. The TSA may include a TSA body extending along an axial direction. The collar may include a collar body, a first collar coupling, and a second collar coupling. The collar body may be formed in a substantially annular shape and extend in the axial direction. The collar may be provided outward from the TSA in a radial direction substantially perpendicular to the axial direction. The first collar coupling and the second collar coupling may be provided on an interior surface of the collar body. The second collar coupling may be axially displaced from the first collar coupling. The TSA body and the collar body overlap in the axial direction. an outer diameter of the collar decreases in a direction from a center of the collar in the axial direction to a first end of the collar in the axial direction. An outer diameter of the collar may decrease in a direction from the center of the collar in the axial direction to a second end of the collar in the axial direction.

An exemplary embodiment of an adapter assembly for use with a wellbore tool string may include a tandem seal adapter and a collar. The TSA may include a TSA body extending along an axial direction, a first seal and a second seal provided to a first side of a center of the TSA body in the axial direction, and a third seal and a fourth seal provided to a second side of the center of the TSA body in the axial direction. The collar may include a collar body, a first collar coupling, and a second collar coupling. The collar body may be formed in a substantially annular shape and extend in the axial direction. The collar may be provided outward from the TSA in a radial direction substantially perpendicular to the axial direction. The first collar coupling provided on an interior surface of the collar body. The second collar coupling providing on the interior surface of the collar body and axially displaced from the first collar coupling. The TSA body and the collar body overlap in the axial direction. The first seal and the second seal may overlap with the first collar coupling in the axial direction. The third seal and the fourth seal overlap with the second collar coupling in the axial direction.

BRIEF DESCRIPTION OF THE SEVERAL VIEWS OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1:
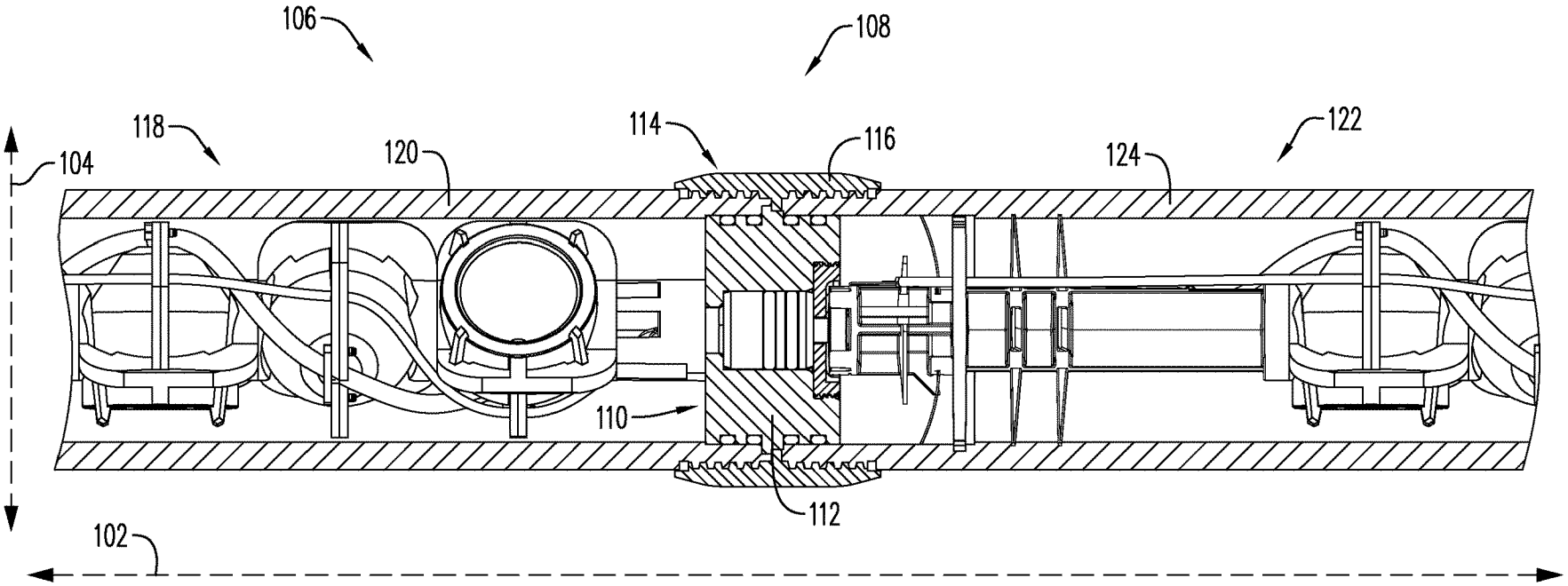
FIG. 1 is a cross-section view of a wellbore tool string according to an exemplary embodiment.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to emphasize specific features relevant to some embodiments.

DETAILED DESCRIPTION

Reference will now be made in detail to various exemplary embodiments. Each example is provided by way of explanation and is not meant as a limitation and does not constitute a definition of all possible embodiments.

The present disclosure may use the term "substantially" in phrases including, but not limited to, "substantially annular shape," "substantially parallel," and "substantially perpendicular," hereinafter summarized as "substantially [x]." In the context of this disclosure, the phrase "substantially [x]" is meant to include both "precisely [x]" and deviations from "precisely [x]" such that the structure would function, from the perspective of one of ordinary skill in the art, in the same way as if it were "precisely [x]." The word "substantially" is not itself limiting but would be readily understood by a person of ordinary skill in the art in view of the exemplary embodiments described in this disclosure and shown in the figures.

FIG. 1 shows an exemplary embodiment of an adapter assembly 108 for use in a wellbore tool string 106. The wellbore tool string 106 may include a first wellbore tool 118 having a first housing 120, a second wellbore tool 122 having a second housing 124, and the adapter assembly 108. The adapter assembly 108 may be configured to mechanically and electrically couple the first wellbore tool 118 to the second wellbore tool 122. Additionally, the adapter assembly 108 may be configured to sealingly isolate the first wellbore tool 118 from the second wellbore tool 122 with regard to fluid and pressure penetration. Additionally, the adapter assembly 108 may be configured to sealingly isolate the first wellbore tool 118 and the second wellbore tool 122 from fluids and pressure exterior to the wellbore tool string 106.

The adapter assembly 108 may include a tandem seal adapter (TSA 110) comprising a TSA body 112. The TSA body 112 may extend along an axial direction 102. In an exemplary embodiment, the TSA body 112 may have a total length of 1 inch or less in the axial direction 102. The adapter assembly 108 may further include a collar 114. The collar 114 may include a collar body 116 formed in a substantially annular shape. The collar body 116 may extend in the axial direction 102. The collar 114 may be provided outward from the TSA 110 in a radial direction 104, the radial direction 104 being substantially perpendicular to the axial direction 102. The TSA 110 and the collar 114 may overlap in the axial direction 102.

Figure 2B:
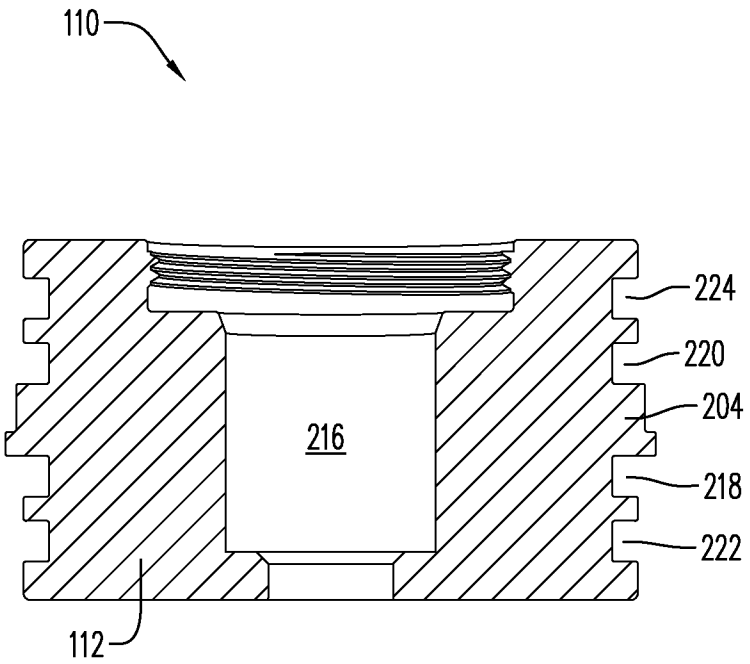
FIG. 2B is a cross-section view of a tandem seal adapter according to an exemplary embodiment.
Figure 2A:
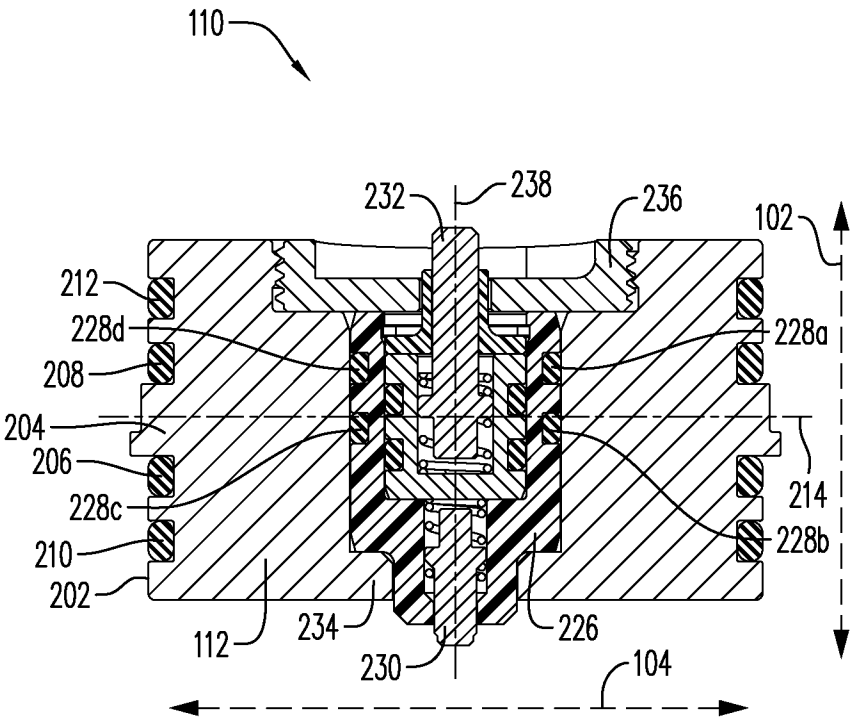
FIG. 2A is a cross-section view of a tandem seal adapter according to an exemplary embodiment.

FIG. 2A and FIG. 2B illustrate an exemplary embodiment of the TSA 110. The TSA 110 may include a TSA rib 204 extending radially outward from the TSA body 112 in the radial direction 104. Further details of the TSA rib 204 will be discussed herein with reference to FIG. 5 and FIG. 7.

As seen in FIG. 2A, the TSA 110 may include sealing elements provided on an outer surface 202 of the TSA body 112. In the example shown in FIG. 2A, the sealing elements may include a first seal 206, a second seal 208, a third seal 210, and a fourth seal 212. However, it will be understood that the specific number of seals may be variable to suit a particular application. In an exemplary embodiment, the first seal 206, the second seal 208, the third seal 210, and the fourth seal 212 may be o-rings. The first seal 206, the second seal 208, the third seal 210, and the fourth seal 212 may be respectively provided within a First TSA seal groove 218, a Second TSA seal groove 220, a Third TSA seal groove 222, and a Fourth TSA seal groove 224 formed in the outer surface 202 of the TSA body 112 (see FIG. 2B).

As seen in FIG. 2A, the first seal 206 and the third seal 210 may be provided to a first side of a TSA center 214 (approximate position of the TSA center 214 is shown by the broken line in FIG. 2A), and the second seal 208 and the fourth seal 212 may be provided to a second side of the TSA center 214.

FIG. 2B shows an exemplary embodiment of the TSA 110, which may further include a bore 216 extending through the TSA body 112. Returning to FIG. 2A, a bulkhead 226 may be provided within the bore 216. Exemplary embodiments of the bulkhead 226 are described in U.S.

patent application Ser. No. 16/819,270, filed Mar. 16, 2020, which is herein incorporated by reference to the extent that it does not conflict with the present application. The bulkhead 226 may sealingly isolate the first wellbore tool 118 from the second wellbore tool 122, for example via bulkhead seals 228*a*, 228*b*, 228*c*, 228*d*.

The bulkhead 226 may include a first electrical contact 230 and a second electrical contact 232 that are in electrical communication through an interior of the bulkhead 226. The first electrical contact 230 is configured to contact a component within the first wellbore tools 118, and the second electrical contact 232 is configured to contact a component with the second wellbore tool 122, thereby providing electrical communication between the first wellbore tool 118 and the second wellbore tool 122 through the TSA 110.

The bulkhead 226 may be retained in the bore 216 by abutting with an interior shoulder 234 of the TSA body 112 at a first end. A retainer nut 236 may be used to retain the bulkhead 226 within the bore 216 at a second end. The retainer nut 236 may be threadedly engaged with the TSA body 112. It will be understood that other structures may be used in place of the retainer nut 236, such as a C-clip or a retainer ring.

Figure 3:
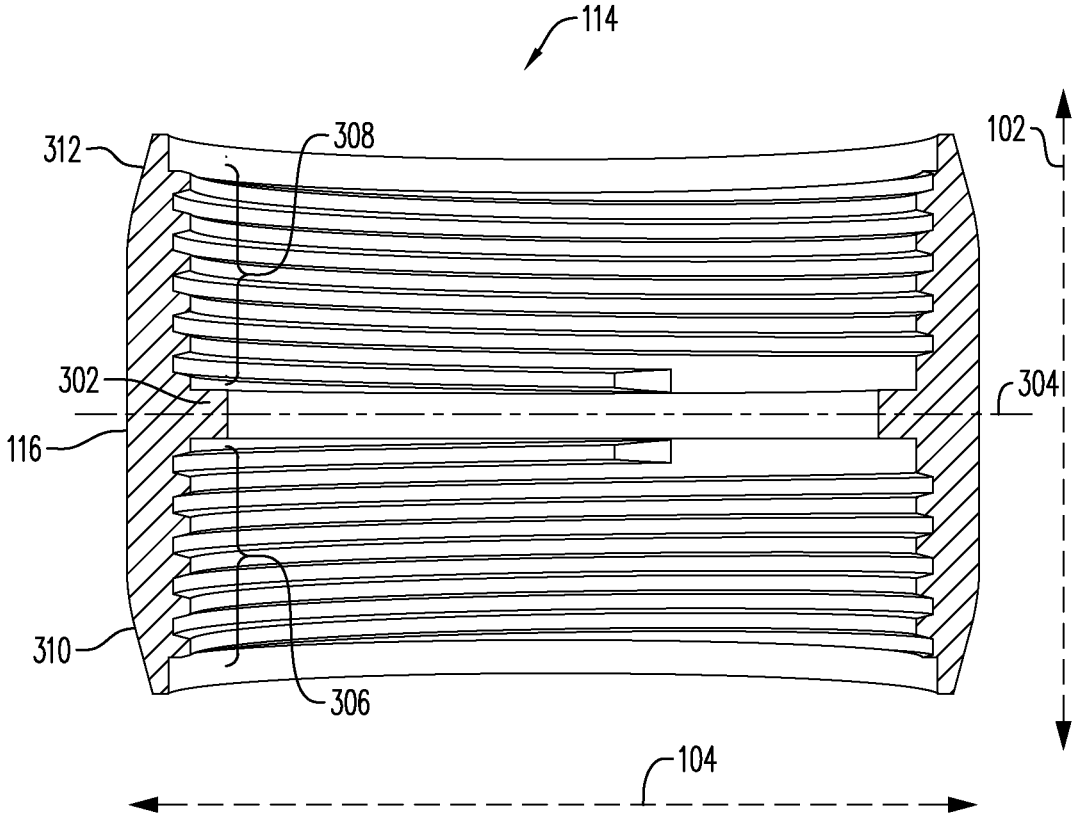
FIG. 3 is a cross-section view of a collar according to an exemplary embodiment.

FIG. 3 illustrates an exemplary embodiment of the collar 114. The collar 114 may include a collar rib 302 extending radially inward from the collar body 116 in the radial direction 104. The collar 114 may further include a first collar coupling 306 and a second collar coupling 308. In an exemplary embodiment, the first collar coupling 306 and the second collar coupling 308 may be provided on an interior surface of the collar body 116. The first collar coupling 306 and the second collar coupling 308 may be embodied as threads formed on the interior surface of the collar body 116. The first collar coupling 306 may be provided to a first side of a collar center 304 in the axial direction 102 (approximate location of the collar center 304 is indicated by the broken line). The second collar coupling 308 may be provided to a second side of the collar center 304 in the axial direction 102.

In an exemplary embodiment, the collar 114 may have a maximum outer diameter of about 3.5 inches at the collar center 304. The collar may further include a first sloped portion 310 and a second sloped portion 312 where an outer diameter of the collar 114 decreases as distance from the collar center 304 increases. This may help to provide a tapered profile at ends of the collar 114 that help to prevent or reduce friction, shock, and damage in the event of impact with a wellbore casing during a pump-down operation.

Additionally, as the outer diameter of the collar 114 may be larger than an outer diameter of connected wellbore tools, the collar 114 may help to prevent contact between the wellbore tools and the wellbore casing, thereby reducing the chance of contact and damage to both the wellbore tools and the wellbore casing. Additionally, larger diameter of the collar 114 may help to centralize wellbore tools within the wellbore, thereby resulting in more consistent diameters of perforations into the surrounding formations.

Figure 4A:
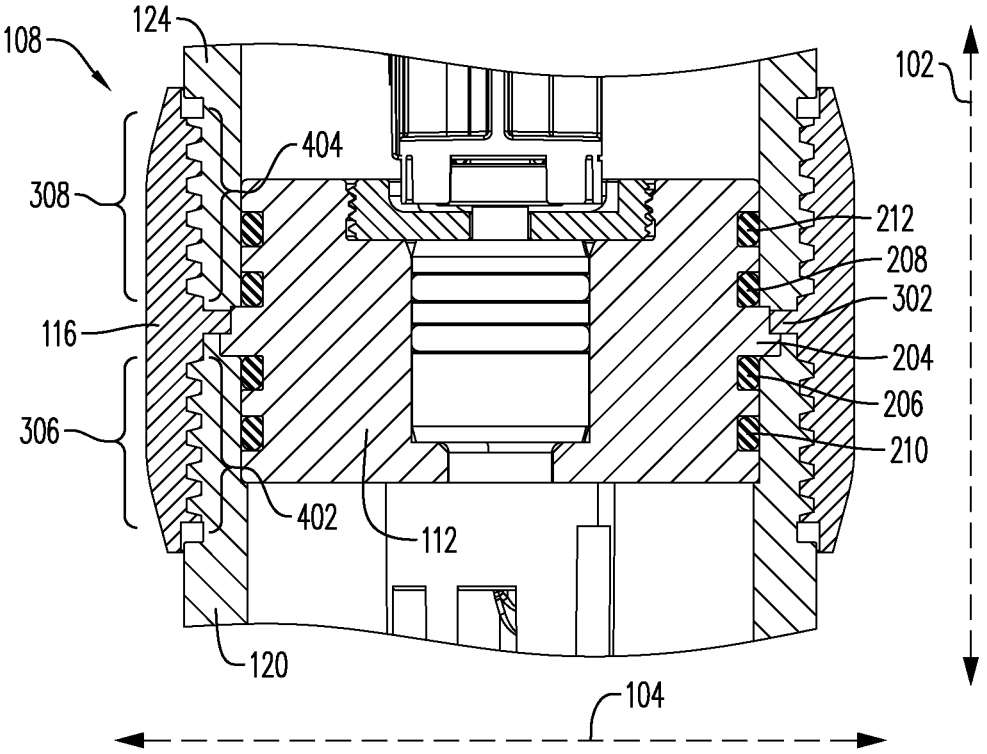
FIG. 4A is an enlarged cross-section view of a wellbore tool string according to an exemplary embodiment.

FIG. 4A is an enlarged cross-section view showing adapter assembly 108. In an exemplary embodiment, the TSA rib 204 and the collar rib 302 may overlap in the axial direction 102. Additionally, the TSA rib 204 and the collar rib 302 may overlap in the radial direction 104. The first seal 206 and the third seal 210 may overlap with the first collar coupling 306 in the axial direction 102, and the second seal 208 and the fourth seal 212 may overlap with the second collar coupling 308 in the axial direction 102. As further seen in FIG. 4A, the first housing 120 may be provided between the first seal 206 and the first collar coupling 306 in the radial direction 104. Additionally, the second housing 124 may be provided between the second seal 208 and the second collar coupling 308 in the radial direction 104.

As further seen in FIG. 4A, a portion of the first housing 120 may be provided between the TSA body 112 and the collar body 116 in the radial direction 104. The first housing 120 of the first wellbore tool 118 may abut one or more of the TSA rib 204 and the collar rib 302. Similarly, a portion of the second housing 124 may be provided between the TSA body 112 and the collar body 116 in the radial direction 104. The second housing 124 of the second wellbore tool 122 may abut one or more of the TSA rib 204 and the collar rib 302. The first housing 120 may include a first tool coupling 402 provided on an outer surface of the first housing 120. Similarly, the second housing 124 may include a second tool coupling 404 provided on an outer surface of the second housing 124. In an exemplary embodiment, the first tool coupling 402 and the second tool coupling 404 may be threads respectively formed on the outer surfaces of the first housing 120 and the second housing 124. The first tool coupling 402 may be configured to engage with the first collar coupling 306 to mechanically couple the first housing 120 to the collar body 116 of the collar 114. Similarly, the second tool coupling 404 may be configured to engage with the second collar coupling 308 to mechanically couple the second housing 124 to the collar body 116 of the collar 114. When the first tool coupling 402 is engaged with the first collar coupling 306, the first seal 206 and the third seal 210 may overlap with both the first tool coupling 402 and the first collar coupling 306 in the axial direction 102. Similarly, when the second tool coupling 404 is engaged with the second collar coupling 308, the second seal 208 and the fourth seal 212 may overlap with both the second tool coupling 404 and the second collar coupling 308 in the axial direction 102.

Using the adapter assembly 108 to connect the first wellbore tool 118 and the second wellbore tool 122 (see FIG. 1) may help to decrease the overall length of the wellbore tool string 106. For example, in an exemplary embodiment, the adapter assembly 108 includes separate pieces such as the TSA 110 and the collar 114. By providing the sealing elements (such as the first seal 206, the second seal 208, the third seal 210, and the fourth seal 212) on the TSA 110 and the coupling elements (such as the first collar coupling 306 and the second collar coupling 308) on the collar 114, the sealing elements and the coupling elements can overlap in the axial direction 102, instead of having to be axially displaced from each other. Accordingly, the overall length of the adapter assembly 108 may be shortened compared with conventional devices. This may allow for shorting of the entire wellbore tool string 106.

Figure 4B:
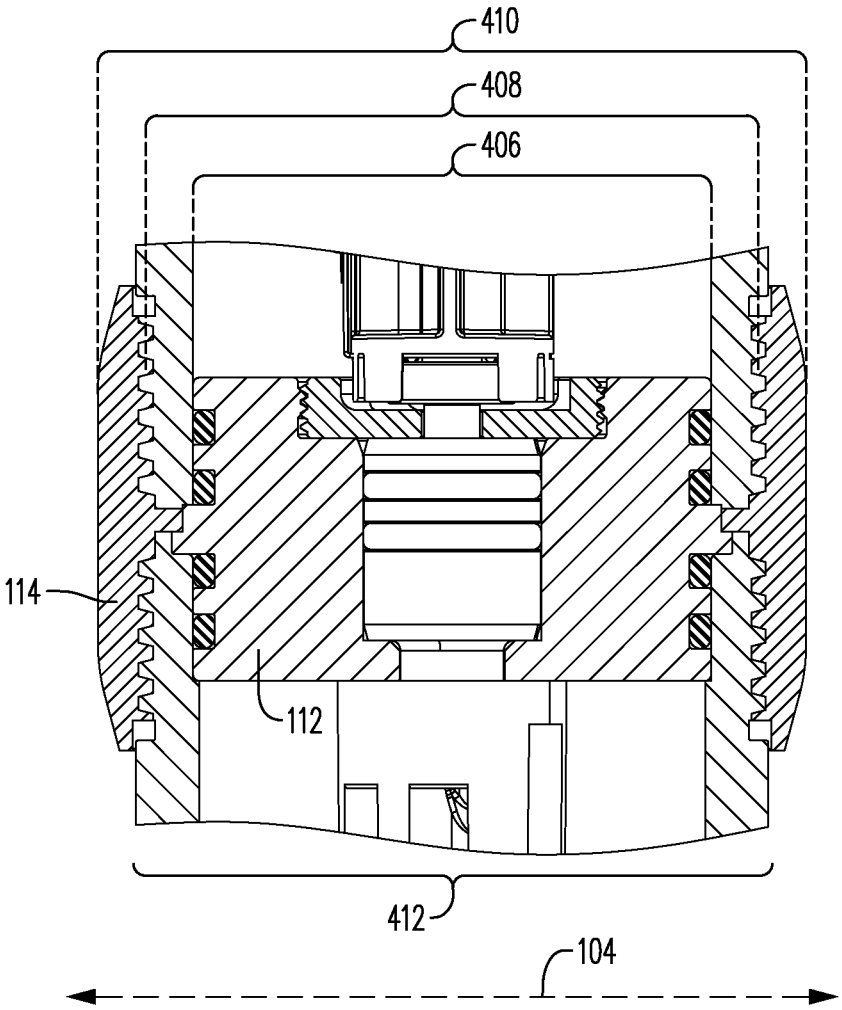
FIG. 4B is an enlarged cross-section view of a wellbore tool string according to an exemplary embodiment.

FIG. 4B shows the relative dimensions of exemplary embodiments of the TSA body 112, the collar 114, and the first housing 120. A TSA body diameter 406 in the radial direction 104 may be smaller than an inner collar diameter 408 in the radial direction 104. An outer collar diameter 410, i.e., an outer adapter assembly diameter, in the radial direction 104 may be larger than an outer tool diameter 412, i.e., an outer first housing diameter, in the radial direction 104. In an exemplary embodiment, the outer collar diameter 410 may be 3.5 inches and the outer tool diameter 412 may be 3.125 inches.

The relative dimensions of the outer collar diameter 410 and the outer tool diameter 412 may help to improve efficiency during pump-down operations of the wellbore tool string 106. For example, because the outer collar diameter 410 is larger than the outer tool diameter 412, the surface area of the wellbore tool string 106 in contact with an inner surface of the wellbore is reduced, thereby reducing surface friction that may acting in opposition to the pump-down operation, especially in applications where the wellbore has a horizontal component with respect to gravity. Further, the differential between the outer collar diameter 410 and the outer tool diameter 412 provides an increased cross-sectional surface area for wellbore fluid to press against during a pump-down operation. In an exemplary embodiment in which the wellbore tools are perforating guns, the outer tool diameter 412 may increase and approach the outer collar diameter 410 following firing of the perforation guns due to gun swell. This may reduce the cross-sectional surface area to facilitate withdrawal of the wellbore tool string 106 from the wellbore.

Figure 5:
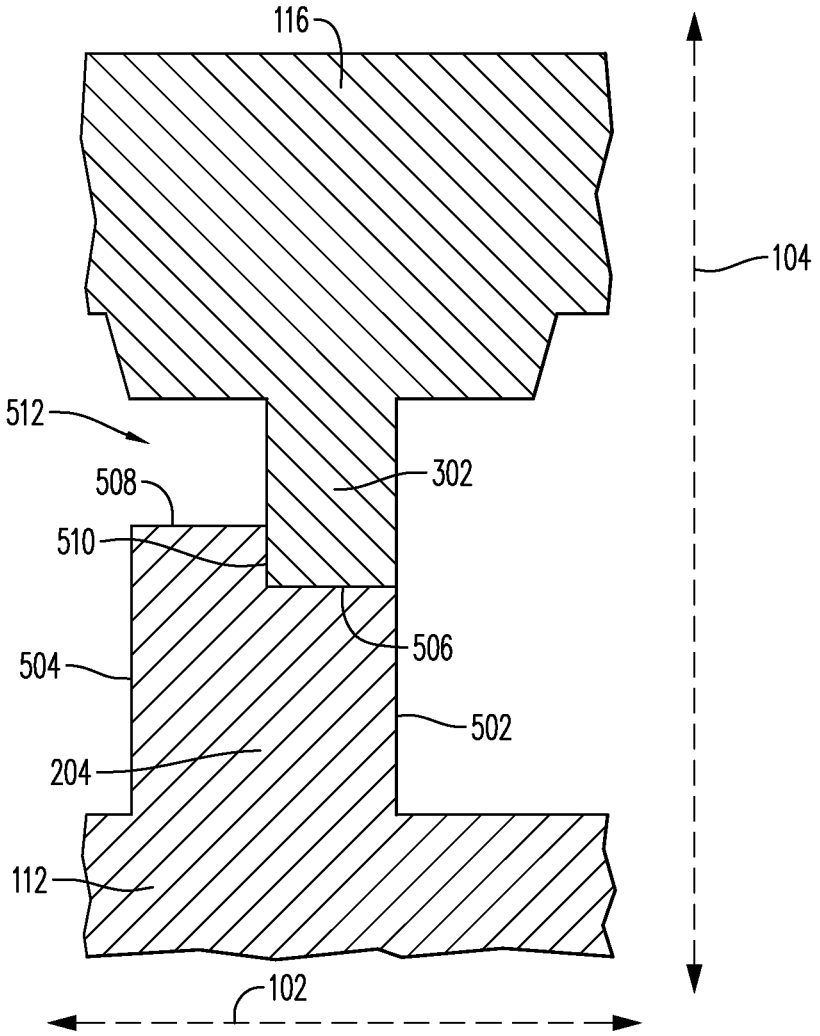
FIG. 5 is an enlarged cross-section view of an adapter assembly according to an exemplary embodiment.

FIG. 5 shows an enlarged cross-section view of an exemplary embodiment of the TSA rib 204 and the collar rib 302. As seen in FIG. 5, the TSA rib 204 has a stepped profile when viewed in cross-section, in other words, when viewed along a plane intersecting with a central axis 238 of the TSA 110. For example, the TSA rib 204 may include a first TSA rib wall 502 extending radially outward from the TSA body 112 in the radial direction 104. The TSA rib 204 may further include a second TSA rib wall 504 extending radially outward from the TSA body 112, with the second TSA rib wall 504 being spaced apart from the first TSA rib wall 502 in the axial direction 102. The TSA rib 204 may further include a first TSA rib step surface 506 extending from the first TSA rib wall 502 in the axial direction 102 toward the second TSA rib wall 504. The TSA rib 204 may further include a second TSA rib step surface 508 extending from the second TSA rib wall 504 in the axial direction 102 toward the first TSA rib wall 502. The first TSA rib step surface 506 and the second TSA rib step surface 508 may be spaced apart in the radial direction 104. The TSA rib 204 may further include a third TSA rib wall 510 extending in the radial direction 104 from the first TSA rib step surface 506 to the second TSA rib step surface 508.

As further seen in FIG. 5, the collar rib 302 and the third TSA rib wall 510 may overlap in the radial direction 104, and the collar rib 302 and the first TSA rib step surface 506 may overlap in the axial direction 102. The collar rib 302 may abut one or more of the first TSA rib step surface 506 and the third TSA rib wall 510. The second TSA rib step surface 508, the collar rib 302, and the collar body 116 may define a recess 512 for receiving a portion of the first housing 120.

Figure 6:
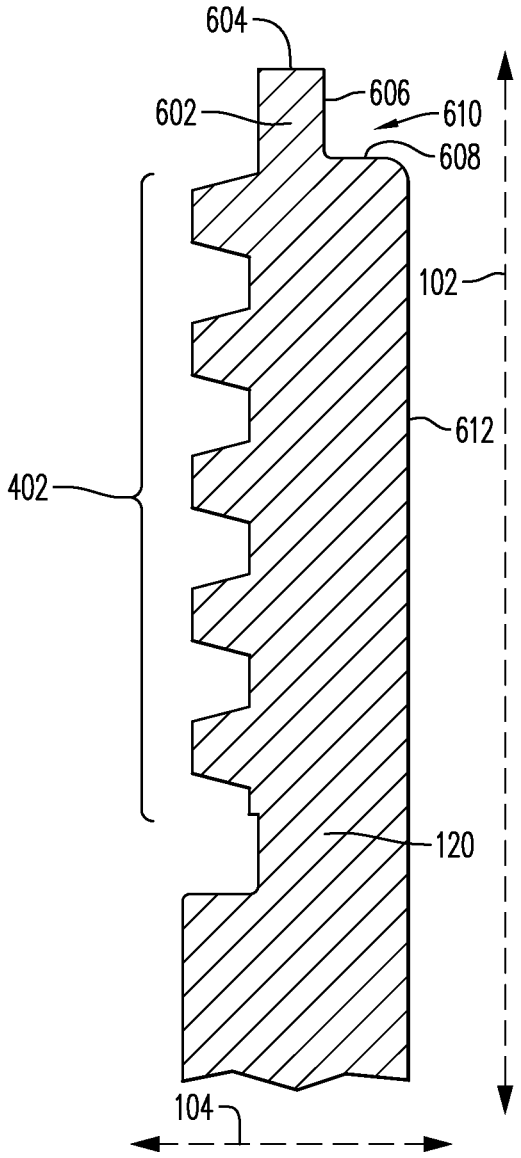
FIG. 6 is an enlarged cross-section view of a wellbore tool housing according to an exemplary embodiment.

FIG. 6 shows an enlarged cross-section view of the first housing 120 according to an exemplary embodiment. The first housing 120 may include a first housing rim 602 provided at a first end of the first housing 120. The first housing rim 602 may be defined in part by a first end surface 604 substantially parallel to the radial direction 104 and a first axial surface 606 extending from the first end surface 604 substantially parallel to the axial direction 102. The first housing rim 602 may be received in the recess 512 (see FIG. 5). The first housing 120 may further include a first tool step surface 608 extending radially inward from the first axial surface 606. The first axial surface 606 and the first tool step surface 608 may define a tool groove 610 formed in a first housing inner surface 612 of the first housing 120.

Figure 7:
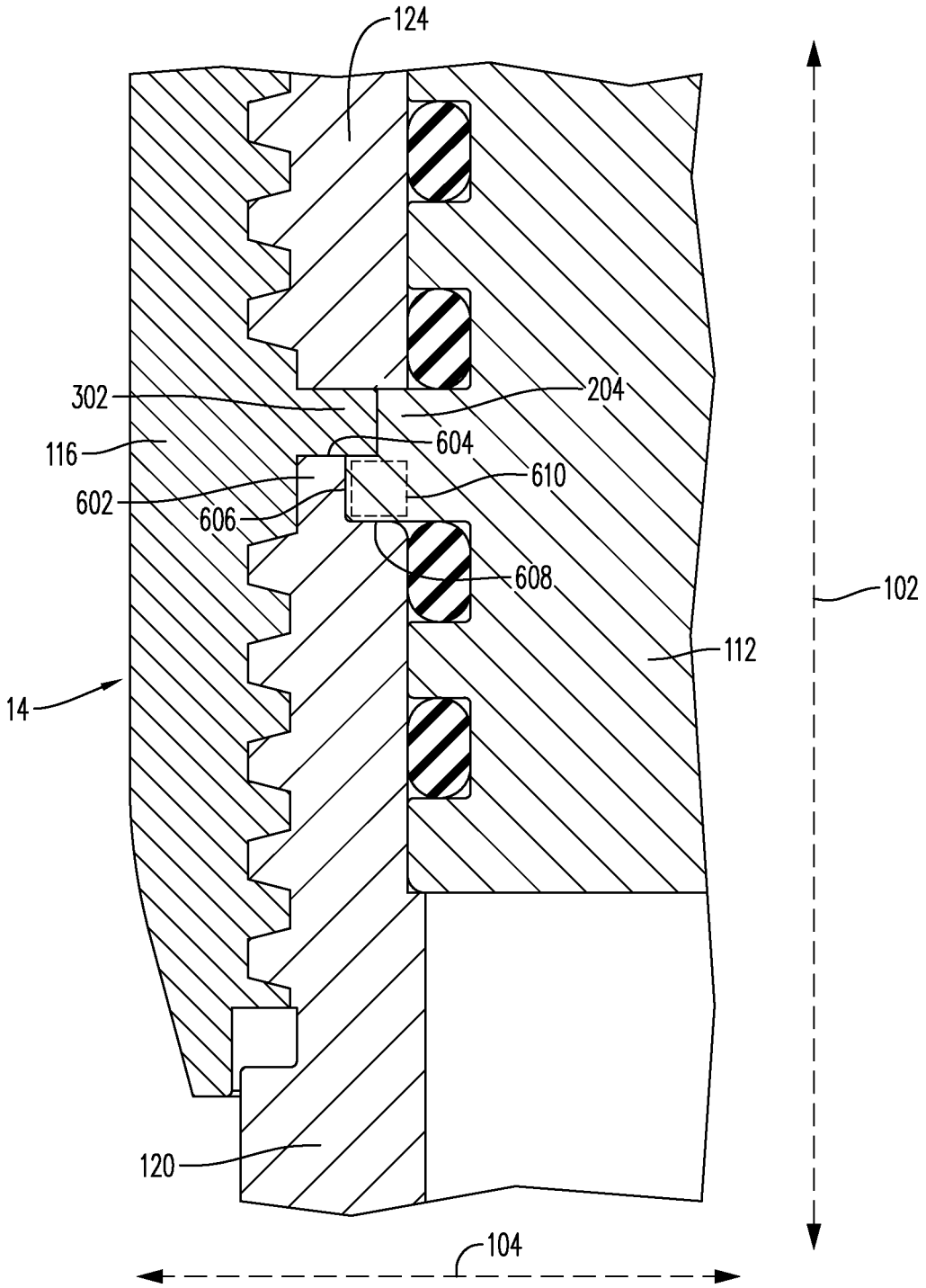
FIG. 7 is an enlarged cross-section view of a wellbore tool string according to an exemplary embodiment.

FIG. 7 shows an enlarged cross-section view illustrating the region of the TSA rib 204, the collar rib 302, and the first housing rim 602. As seen in FIG. 7, at least a portion of the TSA rib 204 is received in the tool groove 610. The first end surface 604 may abut against the collar rib 302. One or more of the first axial surface 606 and the first tool step surface 608 may abut against the TSA rib 204. As can be seen in FIG. 7, at least a portion of the TSA rib 204 may be interposed between the collar rib 302 and the first tool step surface 608 of the first housing 120 in the axial direction 102. This may help to lock the TSA 110 in place and prevent movement of the TSA 110 in the axial direction 102, thereby helping to maintain stable mechanical and electrical connections between the first wellbore tool 118 and the second wellbore tool 122 (see FIG. 1).

Additionally, as seen in FIG. 7, the collar body 116 of the collar 114 is provided radially outward from the first housing 120, with the first housing 120 being interposed between the collar 114 and the TSA body 112. Similarly, the second housing 124 may be interposed between the 114 and the TSA body 112. This may help to strengthen the mechanical coupling between the first wellbore tool 118 and the second wellbore tool 122 (see FIG. 1), thereby reducing the risk of damage, breakage, and/or separation during wellbore operations.

Figure 8:
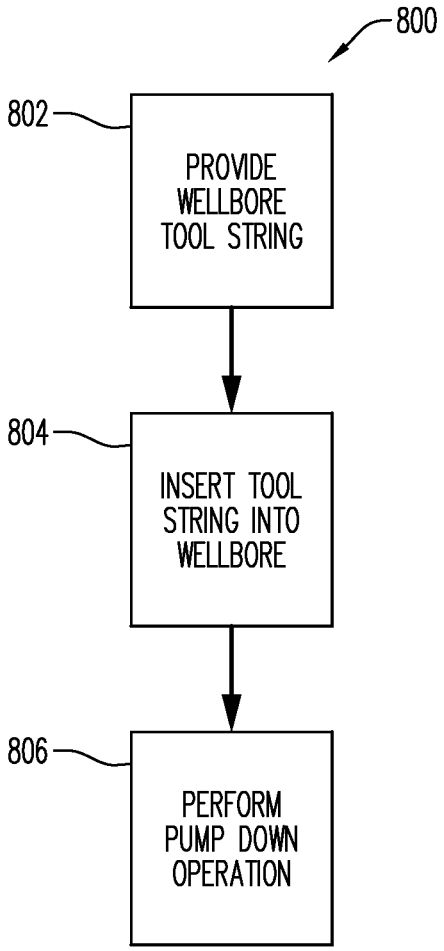
FIG. 8 is a flowchart illustrating a method of using a wellbore tool string according to an exemplary embodiment.

FIG. 8 shows an exemplary embodiment of a method 800 for using a wellbore tool string such as the wellbore tool string 106 (see FIG. 1). In block 802, the wellbore tool string 106 is provided. The wellbore tool string 106 may include the first wellbore tool 118, having the first housing 120, and the adapter assembly 108. The adapter assembly 108 may have an adapter diameter in the radial direction 104 (see outer collar diameter 410 in FIG. 4B) that is larger than the outer tool diameter 412. In block 804, the wellbore tool string 106 is inserted into a wellbore. In block 806, a pump-down operation is performed on the wellbore tool string 106 to position the wellbore tool string 106 at a desired position. For example, the desired position may be a position for firing perforating guns.

As noted above, the differential between the outer collar diameter 410 and the outer tool diameter 412 may be improve efficiency of the pump-down operation by reducing surface area in contact with the wellbore and providing increased cross-sectional surface area for the wellbore fluid to act against.

Figure 9:
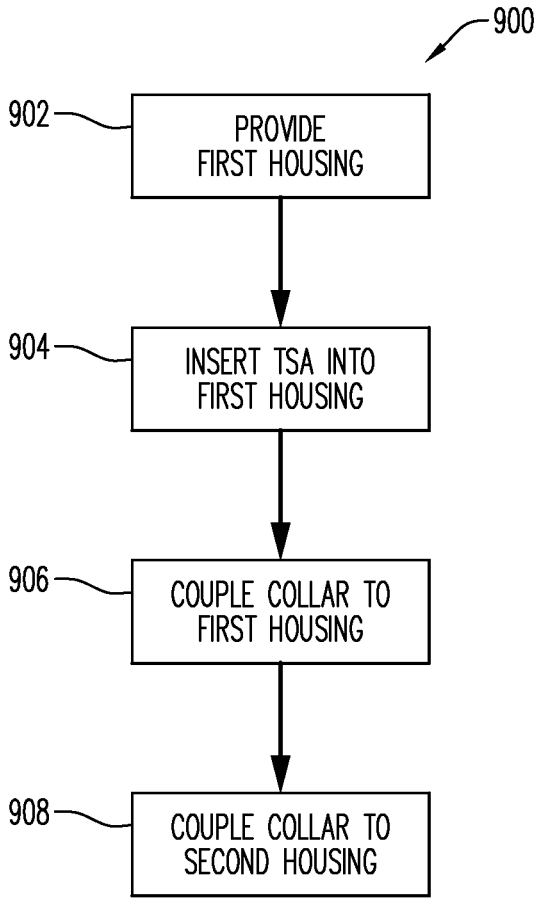
FIG. 9 is a flowchart illustrating a method of assembling a wellbore tool string according to an exemplary embodiment.

FIG. 9 shows an exemplary embodiment of a method 900 for assembling a wellbore tool string such as the wellbore tool string 106 (see FIG. 1). In block 902, the first housing 120 of the first wellbore tool 118 is provided. In block 904, the TSA 110 is inserted into the first housing 120 until the TSA rib 204 abuts with the first housing 120.

In block 906, the collar 114 is coupled to the first housing 120. The portion of the TSA 110 protruding from the first housing 120 may be passed through the interior of the collar 114 until the first collar coupling 306 starts to engage with the first tool coupling 402. In an exemplary embodiment in which the first collar coupling 306 and the first tool coupling 402 are complementary threads, the collar 114 and the first housing 120 may be rotated relative to each other until the collar 114 is securely coupled to the first housing 120, which may occur when the collar rib 302 abuts one or both of the TSA rib 204 and the first housing 120 (see FIG. 4A). In this configuration, a portion of the first housing 120 will be positioned between the TSA body 112 and the collar 114 in the radial direction 104.

In block 908, the collar 114 is coupled to the second housing 124 of the second wellbore tool 122. This may be achieved by inserting the second housing 124 into the collar 114 opposite the first housing 120 to engage the second collar coupling 308 and the second tool coupling 404 (see FIG. 4A). In an exemplary embodiment in which the second collar coupling 308 and the second tool coupling 404 are complementary threads, the collar 114 and the second wellbore tool 122 may be rotated relative to each other until the collar 114 is securely coupled to the second wellbore tool 122, which may occur when the second housing 124 abuts one or both of the TSA rib 204 and the collar rib 302.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B, and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower," etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine," "calculate," and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. An adapter assembly for use with a wellbore tool string, the adapter assembly comprising:

a tandem seal adapter (TSA) comprising a TSA body extending along an axial direction; and a collar comprising:

a collar body formed in a substantially annular shape and extending in the axial direction, the collar being provided outward from the TSA in a radial direction substantially perpendicular to the axial direction;

a first collar coupling provided on an interior surface of the collar body; and a second collar coupling provided on the interior surface of the collar body and axially displaced from the first collar coupling, wherein:

the TSA body and the collar body overlap in the axial direction;

the first collar coupling and the TSA define a first space configured to receive an end of a first housing of a first wellbore tool;

the second collar coupling and the TSA define a second space configured to receive an end of a second housing of a second wellbore tool;

the TSA further comprises a TSA rib extending radially outward from the TSA body in the radial direction;

the collar further comprises a collar rib extending radially inward from the collar body in the radial direction; and wherein the TSA rib and the collar rib overlap in the radial direction.

2. The adapter assembly of claim 1, wherein;

the TSA further comprises a first seal provided on an outer surface of the TSA body; and the first seal overlaps with the first collar coupling in the axial direction.

3. The adapter assembly of claim 2, wherein:

the first seal is provided to a first side of a TSA center of the TSA body in the axial direction;

the first collar coupling is provided to the first side of a collar center of the collar body in the axial direction;

the TSA further comprises a second seal provided on the outer surface of the TSA body to a second side of the TSA center in the axial direction;

the second collar coupling is provided to the second side of the collar center in the axial direction; and the second seal overlaps with the second collar coupling in the axial direction.

4. The adapter assembly of claim 3, wherein:

the TSA further comprises a third seal provided on the outer surface of the TSA body to the first side of the TSA center in the axial direction;

the TSA further comprises a fourth seal provided on the outer surface of the TSA body to the second side of the TSA center in the axial direction;

the third seal overlaps with the first collar coupling in the axial direction; and the fourth seal overlaps with the second collar coupling in the axial direction.

5. The adapter assembly of claim 1, wherein the TSA further comprises:

a bore extending through the TSA body; and a bulkhead provided within the bore;

wherein the bulkhead is configured to provide electrical connectivity through the bore of the TSA body.

6. The adapter assembly of claim 1, wherein the TSA rib and the collar rib overlap in the axial direction.

7. The adapter assembly of claim 1, wherein an outer diameter of the collar decreases in a direction from a center of the collar in the axial direction to a first end of the collar in the axial direction.

8. An adapter assembly for use with a wellbore tool string, the adapter assembly comprising:

a tandem seal adapter (TSA) comprising a TSA body extending along an axial direction; and a collar comprising:

a collar body formed in a substantially annular shape and extending in the axial direction, the collar being provided outward from the TSA in a radial direction substantially perpendicular to the axial direction;

a first collar coupling provided on an interior surface of the collar body; and a second collar coupling provided on the interior surface of the collar body and axially displaced from the first collar coupling, wherein:

the TSA body and the collar body overlap in the axial direction;

a first outer diameter of the collar decreases in a direction from a center of the collar in the axial direction to a first end of the collar in the axial direction;

a second outer diameter of the collar decreases in a direction from the center of the collar in the axial direction to a second end of the collar in the axial direction; and the TSA further comprises a TSA rib extending radially outward from the TSA body in the radial direction;

the collar further comprises a collar rib extending radially inward from the collar body in the radial direction; and wherein the TSA rib and the collar rib overlap in the radial direction.

9. The adapter assembly of claim 8, wherein;

the TSA further comprises a first seal provided on an outer surface of the TSA body; and the first seal overlaps with the first collar coupling in the axial direction.

10. The adapter assembly of claim 9, wherein a first housing of a first wellbore tool is provided between the first seal and the first collar coupling in the radial direction.

11. The adapter assembly of claim 9, wherein:

the first seal is provided to a first side of a TSA center of the TSA body in the axial direction;

the first collar coupling is provided to the first side of a collar center of the collar body in the axial direction;

the TSA further comprises a second seal provided on the outer surface of the TSA body to a second side of the TSA center in the axial direction;

the second collar coupling is provided to the second side of the collar center in the axial direction; and the second seal overlaps with the second collar coupling in the axial direction.

12. The adapter assembly of claim 11, wherein a second housing of a second wellbore tool is provided between the second seal and the second collar coupling in the radial direction.

13. The adapter assembly of claim 12, wherein:

the TSA further comprises a third seal provided on the outer surface of the TSA body to the first side of the TSA center in the axial direction;

the TSA further comprises a fourth seal provided on the outer surface of the TSA body to the second side of the TSA center in the axial direction;

the third seal overlaps with the first collar coupling in the axial direction; and the fourth seal overlaps with the second collar coupling in the axial direction.

14. The adapter assembly of claim 8, wherein the TSA further comprises:

a bore extending through the TSA body; and a bulkhead provided within the bore;

wherein the bulkhead is configured to provide electrical connectivity through the bore of the TSA body.

15. The adapter assembly of claim 8, wherein the TSA rib and the collar rib overlap in the axial direction.

* * * * *